US005170952A

United States Patent [19]

Kamp et al.

[11] Patent Number: 5,170,952

[45] Date of Patent: Dec. 15, 1992

[54] CONTROL MEANS FOR APPARATUS FOR CROSS-WINDING PACKAGES

[75] Inventors: Heinz Kamp, Wegberg; Peter Gerhards; Siegfried Bruns, both of Monchengladbach, all of Fed. Rep. of Germany

[73] Assignee: W. Schlafhorst & Co., Moenchengladbach, Fed. Rep. of Germany

[21] Appl. No.: 725,389

[22] Filed: Jun. 28, 1991

Related U.S. Application Data

[63] Continuation-in-part of Ser. No. 485,754, Feb. 26, 1990, abandoned, which is a continuation of Ser. No. 275,743, Nov. 23, 1988, abandoned.

[30] Foreign Application Priority Data

Nov. 27, 1987 [DE] Fed. Rep. of Germany ..... 3740264

[51] Int. Cl.[5] ..... B65H 54/02; B65H 54/28

[52] U.S. Cl. ..... 242/18 R; 242/18 DD; 242/43 R; 242/43 A; 242/158 B

[58] Field of Search ..... 242/18 R, 18 DD, 43 R, 242/43 A, 36, 45, 158 B

[56] References Cited

U.S. PATENT DOCUMENTS

| | | | |
|---|---|---|---|
| 4,349,160 | 9/1982 | Niederer | 242/18 R |
| 4,371,122 | 2/1983 | Schuller | 242/43 R |
| 4,394,986 | 7/1983 | Hasegawa et al. | 242/18 R |
| 4,494,702 | 1/1985 | Miyake et al. | 242/18 R |
| 4,515,320 | 5/1985 | Slavik et al. | 242/43 R |
| 4,685,629 | 8/1987 | Sugioka | 242/18 R |

FOREIGN PATENT DOCUMENTS

| | | |
|---|---|---|
| 2855616 | 6/1980 | Fed. Rep. of Germany . |
| 659055 | 12/1986 | Switzerland . |

*Primary Examiner*—Stanley N. Gilreath

*Attorney, Agent, or Firm*—Shefte, Pinckney & Sawyer

[57] ABSTRACT

Control means are provided for an apparatus for cross-winding packages of textile yarn or the like. The control means includes means operable during at least a portion of the rotation of the package at the selected rotational speed for increasing the relative frequency of traverse of the yarn guide means with respect to the selected rotational speed to a ratio less than the ratio of the rotational speed to the relative frequency of traverse prior to rotation at the selected rotational speed. The control means can gradually increase the relative frequency during operation at the selected rotational speed so that the ratio of the rotational speed to the relative frequency of traverse of the yarn guide means gradually decreases from the ratio of the rotational speed to the relative frequency of traverse at the beginning of rotation at the selected rotational speed.

2 Claims, 2 Drawing Sheets

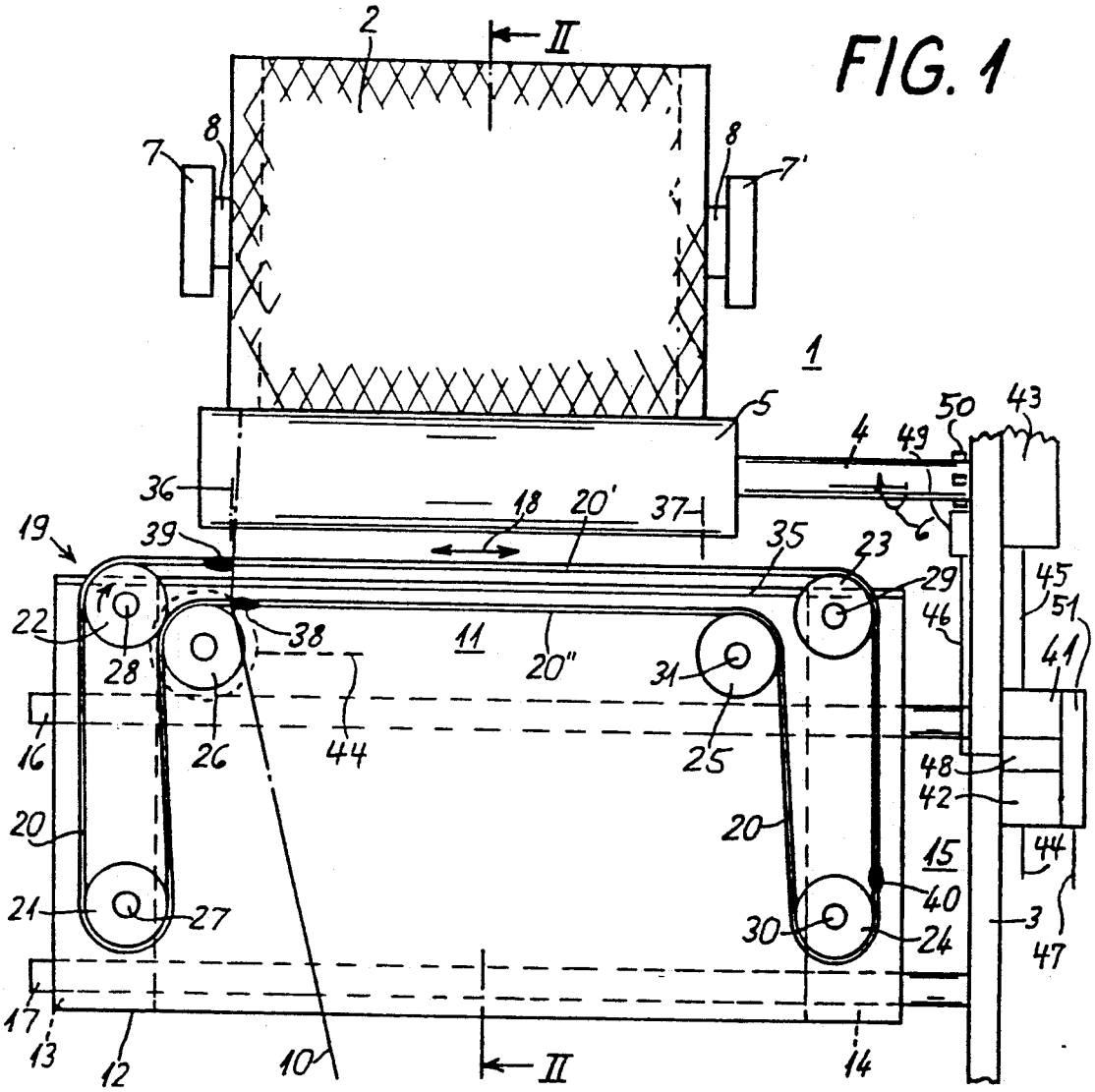
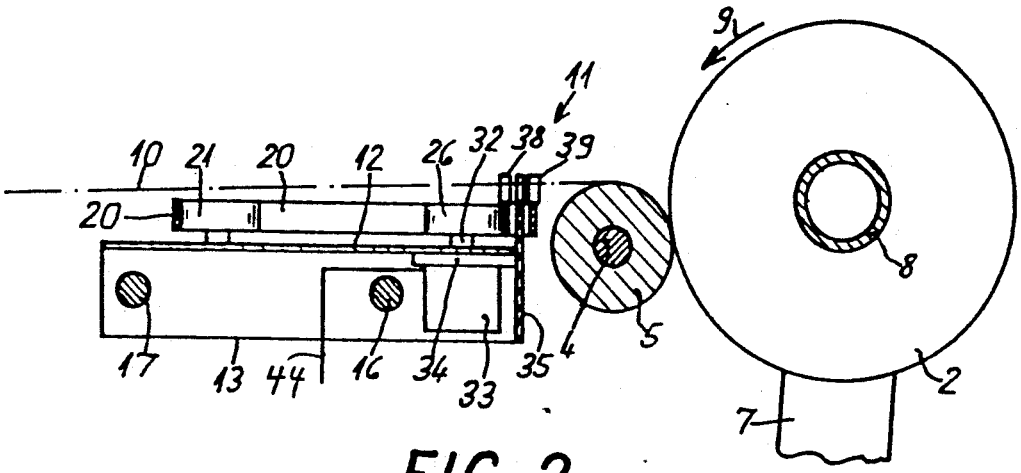
FIG. 2

CONTROL MEANS FOR APPARATUS FOR CROSS-WINDING PACKAGES

This is a continuation-in-part of application Ser. No. 07/485,754, filed Feb. 26, 1990, now abandoned, which is a continuation of application Ser. No. 07/275,743, filed Nov. 23, 1988, now abandoned.

BACKGROUND OF THE INVENTION

The present invention relates to control means for apparatus for crosswinding a package of textile yarn, and more particularly to such control means that varies the ratio of the rotational speed of the package and the frequency of yarn guide traverse.

It is known to cross-wind yarn onto a package in which the package is rotated at differing rates of rotation during the winding process. For example, the package may be rotated at a higher than normal speed during a high speed winding period or the package may be wound at a speed different than the normal winding speed during the time the package is accelerated from a standstill to its normal speed. Typically, during the running phase of operation either the same crossing angle exists as during the period before the running phase or no attention is paid to the yarn crossing angle. Imperfections in the package and undesirable production in the quality of the yarn in the package can occur during and possibly due to maintenance of the traversing frequency, and thereby the crossing angle, constant during rotation of the package at running speed as well as at the beginning and end of the operation at running speed.

SUMMARY OF THE INVENTION

The present invention provides control means that result in the advantage of significantly minimizing defective yarn and other disturbances by controlling the relation between the speed of rotation and the frequency of traversing, thereby controlling and varying the yarn winding angle, particularly during and at the beginning and ending of the rotation of the package during the normal running phase.

Briefly described, the present invention provides control means in an apparatus for cross-winding packages of textile yarn or the like wherein means are provided for rotating the package at a selected package shaft rotational speed during a normal operating period in which yarn is built on the package and wherein a traversing guide means is provided for cross-winding yarn on the rotating package at a frequency of traverse with respect to the package shaft rate of rotation. The control means includes means operable after a shutdown event in which the drive motor which drives the package during normal package building operation is de-activated. The means operable after the shutdown event controls the frequency of traverse of the yarn guide means with respect to the package shaft rate of rotation, which gradually decreases after the de-activation of the drive motor, to a ratio less than the ratio during the normal package building operation prior to the shutdown event. Preferably, the control means increases the frequency of traverse after the shutdown event in correspondence with the measured decreasing package shaft rate of rotation to thereby avoid abrupt operational changes. The control of the frequency of traverse relative to the decreasing package shaft rate of rotation to achieve a desired ratio of the package shaft rate of rotation to the frequency of traverse after a shutdown event advantageously results in an increased pitch or helix angle of the yarn built on the package after the shutdown event relative to the yarn built on the package during the normal package building operation, thereby minimizing the risk that the layers of yarn built on the package after the shutdown event will slough off or otherwise fall from the package.

BRIEF DESCRIPTION OF THE DRAWINGS

FIG. 1 is a front elevational view of one preferred embodiment of the control means of the present invention incorporated in an apparatus for cross-winding packages of textile yarn;

FIG. 2 is a vertical sectional view taken along line II—II of FIG. 1.

DETAILED DESCRIPTION OF THE PREFERRED EMBODIMENTS

Figure 3:
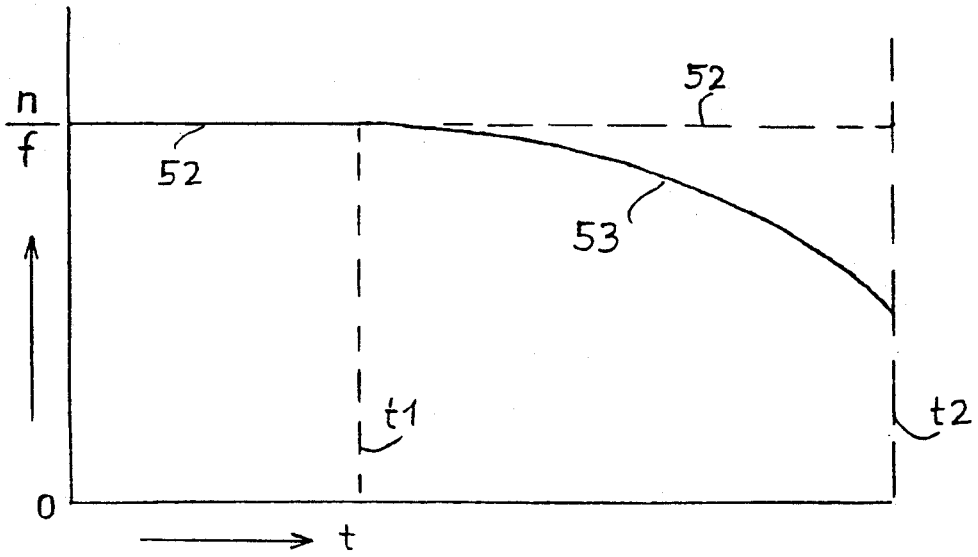
FIG. 3 is a graphical representation of one measurement of the winding operation, showing the ratio of the speed of rotation of the package to the frequency of reciprocation of the traversing yarn guide plotted on the ordinate and the time elapsed during the winding of the package plotted on the abscissa.

Referring to FIG. 1, an apparatus is shown for cross-winding yarn 10 onto a package 2 at a winding station of a winding machine 1. A supporting frame 3 rotatively supports a shaft 4 of a friction roller 5 for rotation in the direction indicated by the arrow 6. The friction roller 5 frictionally drives the package 2 which is formed on a sleeve 8 which is rotatively supported by a pair of swivelable, hanging support frames 7,7', whereby the package 2 rotates in the direction indicated by the arrow 9 in FIG. 2.

The shaft 4 rotates about its axis at a shaft rotation speed and the sleeve 8 rotates about its axis at a package shaft rate of rotation corresponding to the shaft rate of rotation of the shaft 4.

The frame 3 also supports a traversing yarn guide means or system 11 which includes a support frame 12 of generally rectangular shape having a pair of flanges 13,14 at each respective longitudinal end. The flanges 13,14 are mounted on a pair of spaced, parallel guide bars 16,17 extending perpendicular from the flanges 13,14 and fixedly secured to the frame 3. The yarn guide system 11 traverses yarn 10 in the directions indicated by the double arrow 18 as the yarn, which is trained around the frictional roller 5 and onto the package 2, is continuously wound onto the package 2.

The yarn guide system 11 includes a belt assembly 19 having an endless belt 20 trained around guide rollers 21,22,23,24 and 25 and around a drive roller 26. The guide rollers 21–25 are rotatively mounted on a plurality of shafts 27–31, respectively, projecting perpendicularly from the rectangular surface of the support frame 12. The drive roller 26 is fixedly mounted to a shaft 32 of an electric motor 33 having a flange 34 which is secured to the back rectangular surface of the support frame 12.

The endless belt 20 is driven by the drive roller 26 in a loop around the guide rollers 21–25 such that the belt moves from left to right along a path 20' (i.e., in the direction from the guide roller 22 toward the guide roller 23) and from right to left along a second travel path 20'' (i.e., in the direction from the guide roller 31 toward the drive roller 26).

The yarn guide system 11 also includes a yarn guide plate 35 secured to the support frame 12 and projecting beyond its front rectangular surface. The yarn guide plate 35 has a contoured top edge over which the yarn 10 passes as it moves toward the frictional roller 5. The endless belt 20 includes a plurality of yarn engaging elements 38,39 and 40 which are uniformly spaced along the belt for cooperating with the yarn guide plate 35 to traverse the yarn 10 in the direction indicated by the double arrow 18 along the extent defined by the two-lines 36,37 in FIG. 1. The contoured edge of the yarn guide plate 35 has a concave profile with its lowermost portion in alignment with the longitudinal midpoint of the plate and extending upwardly therefrom in both directions toward the longitudinal ends of the plate such that when the yarn 10 is guided by one of the yarn engaging elements 38,39 or 40 along the traversing path 20'' to an engagement position generally in alignment with the dash line 36 the plate will cause the yarn to disengage from the yarn engaging element and be engaged by the next successive yarn engaging element 38,39 or 40 traveling in the opposite direction along the traversing path 20' to an engagement position generally in alignment with the dash line 37 for engagement by the next successive engaging element 38,39 or 40 traveling along the travel path 20''. The yarn engaging elements 38,39 and 40 are enlarged portions of the belt 20, each having a face projecting at a generally steep angle from the endless belt 20 for engaging the yarn 10. The faces of the yarn engaging elements 38,39 and 40 are sheathed in metal sleeves for protection against abrasive wear.

The foregoing package winding apparatus and yarn traversing guide system are known in the art and do not form part of the present invention except in combination with the control means of the present invention. Further, the control means of the present invention is applicable to other types of yarn guide systems for traversing yarn during winding on a rotating package.

The shaft 4 of the friction roller 5 is driven by an electric motor 43 which is fixedly supported on the frame 3. The electric motor 43 for rotating the package and the electric motor 33 for operating the yarn guide system are frequency controlled motors. The motor 33 is connected by a connector 44 to a frequency converter 42 and the electric motor 43 is connected by a connector 45 to a frequency converter 41. The frequency converters 41,42 are coupled to a common control unit 48 which is connected through a connector 46 with a sensor 49. The sensor 49 senses the passage thereby of four circumferentially uniformly spaced marks 50 on the shaft 4 and generates a signal to the control unit 48 in response to the passage thereby of one of the marks 50. The data relating to the passage of the mark 50 by the sensor 49 is a measure of the rotational characteristics of the shaft 4, the friction roller 5 and, accordingly, the package 2.

The frequency with which the marks 50 move past the sensor 49 is therefore a measure of the shaft rate of rotation of the shaft 4 and, correspondingly, a measure of the package shaft rate of rotation of the package 2. As the package 2 rotates, the yarn guided thereto by the yarn guide system 11 builds on the already wound layers of yarn and the diameter of the package 2 accordingly continuously increases as additional yarn is built thereon. Each newly added layer of yarn built on the package 2 is thus at a greater radius from the axis of the sleeve 8 and correspondingly rotates at a greater surface speed than the previously added layers of yarn which are at a lesser radius to the axis of the sleeve 8.

A central unit 51 connects the two frequency converters 41,42 and the control unit 48 with one another and additionally provides power. The central unit 51 receives power through a conductor 47 from a power source (not shown).

During the winding process, the central unit 51, by the frequency converter 41, controls the electric motor 43 to rotate the package. The sensor 49 senses the rate of rotation of the shaft 4 and the control unit 48 controls, via the frequency converter 42, the electric motor 43, such that the desired n:f ratio as graphically represented in FIG. 3 is achieved.

The control unit 48 controls the operation of the motor 33 to thereby operate the yarn guide system 11 in such a manner that the winding process characteristics graphically displayed in FIG. 3 is achieved.

FIG. 3 is a graphical illustration of the package shaft rate of rotation (hereinafter the rate of rotation n of the package 2) to the frequency f of the yarn guide system 11 as measured over a period of time t beginning at $t=0$ and progressing through $t=t1$ to $t=t2$. In FIG. 3, the ratio of the rate of rotation n of the package 2 to the frequency f of the traversing yarn guide system 11 is plotted on the ordinate and the time elapsed during winding of the package 2 is plotted on the abscissa. The frequency f of the yarn guide system 11 is a measurement of the frequency of the system in moving the yarn 10 from one of the dash lines 36,37 to the other of the dash lines and back to the original dash line, which comprises one cycle.

In FIG. 3, a plot 52 of the n:f ratio extends from time $t=0$ to time $t=t1$ and this time period of $t=0$ to $t=t1$ is representative of a period of time during which the package shaft rate of rotation is at a predetermined value (or at a series of predetermined values) prescribed by the normal package building operation just before the occurrence of a shutdown event at time $t=t1$. The package shaft rate of rotation during the normal yarn building operation (in other words, at a time preceding the time $t=0$ up to the time $t=t1$ and including the time $t=0$ to $t1$), normally follows a predetermined set of decreasing values so that the surface speed of the package 2 is decreased in correspondence with the increasing diameter of the package.

Yarn is wound on the package 2 in a conventional winding method commonly referred to as random winding, in which the ratio n:f is decreased in correspondence with the increasing package diameter to maintain the pitch or helix angle of the yarn being built on the package at a substantially constant value. The pitch or helix angle of the yarn being built on the package is the angle formed between the yarn and a plane perpendicular to the axis of the package 2. The n:f ratio thus decreases during normal package building, which is the period of time generally commencing when the package shaft rotation speed has been accelerated from a value of 0 to an initial package building speed and extending to the shutoff event at the time $t=t1$. The shutoff event can be the stopping of the motor 43 in response to the completion of the building of the package 2 or the shutoff event can be the stopping of the motor 43 in response to an operation interruption such as, for example, a break in the yarn 10 being fed onto the package 2. The deactivation of the motor 43 in response to either the completion of building of the package 2 or an operational interruption results in a situation in which the shaft 4 continues to rotate due to inertia at a shaft rate of rotation which decreases over time and the package 2 continues to correspondingly rotate about its axis after the de-activation of the motor 43 with the package shaft rate of rotation (the rate of rotation n) decreasing ultimately to a value of 0 as the package comes to a standstill. The time period from t=t1 to t=t2 shown in FIG. 3 is the time period following a shutdown event and the plot 53 graphically illustrates the n:f ratio in accordance with the method of the present invention which is achieved through control of the yarn change guide device 11 in correspondence with the decreasing package shaft rate of rotation of the package 2.

Since the package shaft rate of rotation decreases during normal package building operation as the diameter of the package 2 increases, the n:f ratio decreases if the frequency of traverse f remains constant. The plot 52 in FIG. 3 depicts the n:f ratio as essentially constant during the time immediately before a shutdown event at the time t=t1. However, the decrease in the n:f ratio during the time period t=0 to t=t1 is, in order of magnitude, relatively so much less than the decrease in the ratio n:f during the time period after the shutdown event (the time period from t=t1 to t=t2) that the n:f ratio during the time period immediately before the shutdown event can be essentially regarded as constant, as depicted by the linear nature of the plot 52.

To achieve the n:f ratio depicted by the plot 53 after the shutdown event at the time t=t1, the control unit 48 controls the yarn guide system 11 to increase the frequency of traverse f relative to the rate of rotation n, which is decreasing due to the deceleration of the package 2 as the rotation of the package caused by inertia gradually diminishes. The n:f ratio is decreased after the shutdown event as graphically illustrated by the plot 53 to achieve a desirable building of the yarn onto the package following the shutdown event. Specifically, in accordance with the method of the present invention, it is desired to build the layers of yarn built on the package 2 after the shutdown event in such a manner that these final yarn layers do not slough off or fall from the package 2. It has been found that sloughing off of the final layers of yarn can be minimized if the pitch or helix angle of these final layers of yarn added to the package 2 after a shutdown event is increased relative to the helix angle of the layers of yarn built on the package during normal package building operations before the shutdown event. If the n:f ratio were not altered after the shutdown event at the time t=t1, the final layers of yarn built on the package would be at essentially the same helix angle as the previously built layers of yarn and sloughing off of these layers may disadvantageously occur. The broken line 52 in FIG. 3 graphically illustrates the n:f ratio which would occur if the yarn guide system 11 were not controlled during the time t1 to the time t2to achieve the n:f ratio illustrated by the plot 53.

Due to the decrease in the n:f ratio after the shutdown event at the time t1, the helix angles of the layers of yarn added during this time period are relatively greater than the helix angle of the yarn layers added during the time period from t=0 to t=t1 preceding the shutdown event. The n:f ratio during the time period t1 to t2 (i.e., the plot 53) is a lesser value than any n:f ratio during the normal operation period whose final segment before the shutdown event at the time t=t1 is represented by the plot 52.

The sensor 49 senses the frequency with which the marks 50 on the shaft 4 are rotated therepast during the gradually decreasing rotation of the shaft 4 after the shutdown event and this information is relayed to the control unit 48. Since the package shaft rate of rotation of the package 2 decreases in correspondence with the decreasing rate of rotation of the shaft 4 after the shutdown event, the decreasing shaft rate of rotation of the shaft 4 is representative of the decreasing package shaft rate of rotation of the package 2 and the control unit 48 controls the frequency f of the traverse of the yarn guide system 11 in correspondence with the measured decreasing shaft rate of rotation of the shaft 4 to conform the n:f ratio to the plot 53 during the time period t1 to t2.

In one embodiment of the present invention, the control unit 48 operates the delay stopping the traversing of the yarn guide system 11 until after the motor 43 has stopped rotating the shaft 4 and package 2. Further, the control unit 48 may control the yarn guide unit 11 to delay increasing the frequency until after the package is rotating at the running speed.

In certain circumstances, it may be preferable to directly sense the rate of rotation of the package 2 rather than sense the rate of rotation of the shaft 4.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In an apparatus for cross-winding packages of textile material having means for rotating a package on a shaft at a selected constant shaft rotation speed during a normal operation period and a traversing yarn guide means for cross-winding yarn on the rotating package at a frequency of traverse (f) selected in correspondence with the contemporaneous rate of rotation (n) of the rotating shaft, the ratio of the rate of rotation (n) to the frequency of traverse (f) being expressed as n:f, and the shaft being operatively connected to the means for rotating the package such that the shaft rotates at an increasingly reduced speed of shaft rotation during a running out period following de-activation of the means for rotating the package, with the increasingly reduced speed of the shaft decreasing from the selected constant shaft rotation speed, means for controlling the frequency of traverse (f) with respect to the rate of rotation (n) to produce a lesser n:f ratio during said running out period than the n:f ratio during the operational period of constant shaft rotation speed prior to said running out period.

2. A method for cross-winding packages of textile material or the like through the axial traversal of the textile material during rotation of the package on a rotating shaft, the frequency of traverse (f) varying in a predetermined manner with the contemporaneous rate of rotation (n) of the shaft, comprising:

rotating the shaft at a selected constant shaft rotation speed during a normal operation period;

controlling the frequency of traverse (f) during the normal operation period in correspondence with the selected constant shaft rotation speed to achieve a predetermined normal speed ratio of the selected constant shaft rotation speed to the frequency of traverse (f);

increasingly reducing the rotational speed of the shaft (n) during a running out period; and controlling the frequency of traverse (f) relative to the increasingly reduced shaft rotation speed (n) during said running out period to produce a lesser n:f speed ratio during said running out period.

* * * * *